United States Patent [19]

Shibata

[11] Patent Number: 4,460,049

[45] Date of Patent: Jul. 17, 1984

[54] IMPACT WRENCH

[75] Inventor: Ryoichi Shibata, Habikinoshi, Japan

[73] Assignee: Kabushiki Kaisha Kuken, Osaka, Japan

[21] Appl. No.: 340,669

[22] Filed: Jan. 19, 1982

[30] Foreign Application Priority Data

Jan. 27, 1981 [JP] Japan ..... 56-11088

[51] Int. Cl.[3] ..... B25B 19/00

[52] U.S. Cl. ..... 173/93.5; 173/94; 173/93; 81/463

[58] Field of Search ..... 173/93, 93.5, 94; 81/463, 464, 465, 466

[56] References Cited

U.S. PATENT DOCUMENTS

| | | | |
|---|---|---|---|
| 2,940,566 | 6/1960 | Conover | 173/93.5 |
| 3,212,293 | 10/1965 | Barnett | 173/93 X |
| 4,347,902 | 9/1982 | Wallace et al. | 173/93.5 |

*Primary Examiner*—E. R. Kazenske
*Assistant Examiner*—Willmon Fridie, Jr.
*Attorney, Agent, or Firm*—Jordan and Hamburg

[57] ABSTRACT

An impact wrench includes a hammer, an anvil and a rotor driven by a motor, the hammer being swingeable in either direction with respect to the rotary axis of the rotor, the hammer resting on the anvil in a spring-loaded state so as to enable the hammer to line up with the axis of the anvil, the hammer including means for engaging itself with the inside surface of the rotor, whereby the hammer produces impacts at fixed intervals and transmits the same to the anvil.

5 Claims, 9 Drawing Figures

IMPACT WRENCH

BACKGROUND OF THE INVENTION

The present invention relates to an impact wrench for use in fastening or unfastening bolts or nuts, and more particularly, to an impact wrench for such use, having an improved rotor system capable of producing impacts at fixed intervals and transmitting the same to the bolt or nut to be fastened or unfastened, in which harsh noises are not caused.

A conventional impact wrench has a hammer carried on a rotor driven by a motor, which hammer is caused to rotate in association with the rotor during which the hammer repeats its engagement and disengagement with an anvil, which has a recess to meet the hammer, thereby transmitting impacts thereto. However, this has drawbacks as follows:

As the centrifugal force varies with the peripheral speed of the rotor, the strength of the impact differs from impact to impact. In addition, a lubricant oil is unevenly circulated, and is likely to gather at unnecessary parts at the high speed of the rotor. As a result, necessary parts remain unlubricated. What is more, harsh noises are produced each time the hammer hits the anvil, which causes the problem of noise pollution.

OBJECTS AND SUMMARY OF THE INVENTION

The present invention aims at solving the problems pointed out with respect to the conventional impact wrench, and has for its object to provide an improved impact wrench having an improved arrangement of a rotor, a hammer and an anvil whereby impacts are produced at fixed intervals to fasten or unfasten bolts or nuts.

Another object of the present invention is to provide an improved impact wrench capable of producing impacts without causing harsh noise.

Other objects and advantages will become more apparent from the following description when taken in connection with the accompanying drawings which show, for the purpose of illustration only, one embodiment in accordance with the present invention.

According to the present invention, an impact wrench includes a hammer, an anvil and a rotor driven by a motor, the hammer being swingeable in either direction with respect to the rotary axis of the rotor, the hammer resting on the anvil in such a spring-loaded state as to enable the hammer to line up with the axis of anvil, the hammer including means for engaging itself with the inside surface of the rotor, whereby the rotor transmits its motion to the hammer.

DETAILED DESCRIPTION OF THE INVENTION

Figure 1:
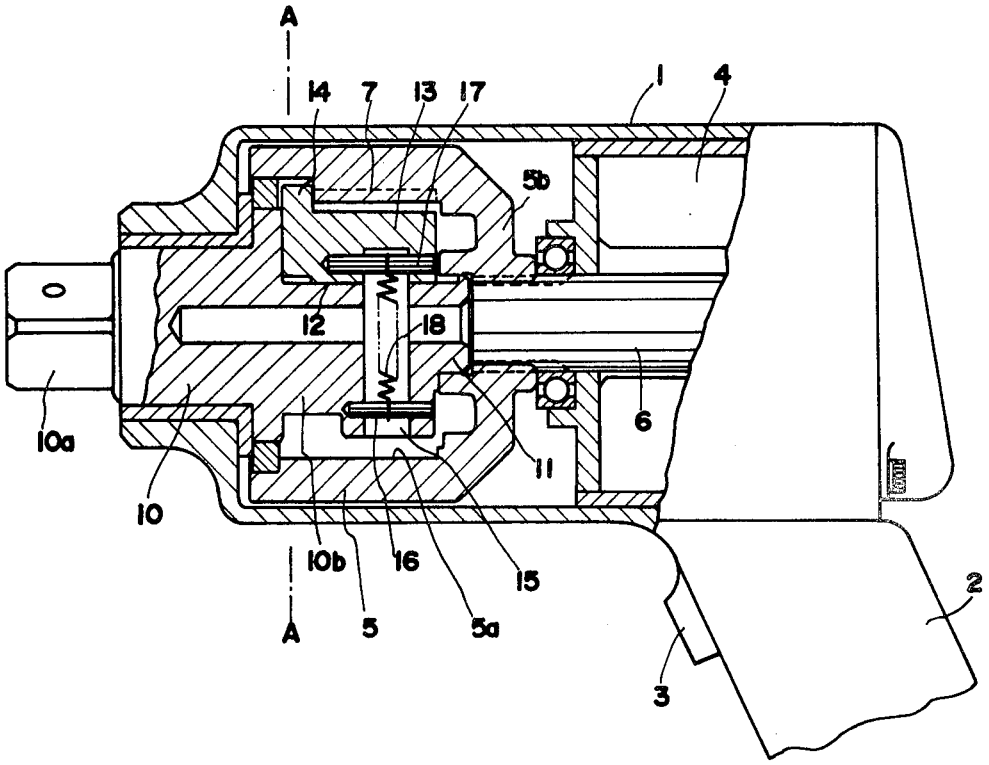
FIG. 1 is a vertical cross-section through an impact wrench according to the present invention.
Figure 2:
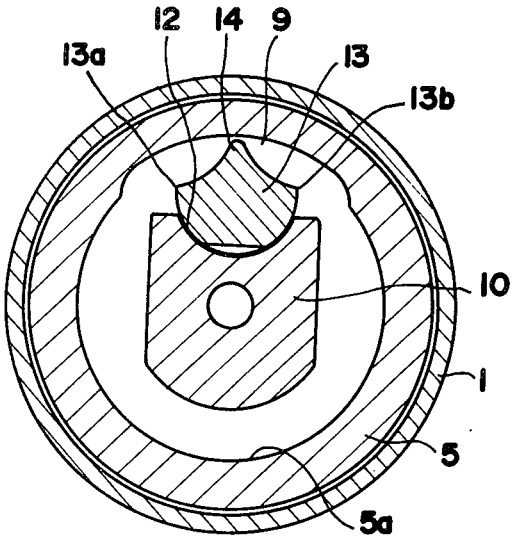
FIG. 2 is a vertical cross-section taken along the line A—A in FIG. 1.
Figure 3:
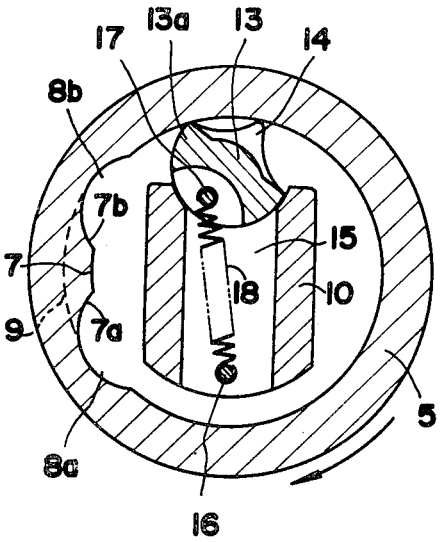
FIGS. 3 to 7 are cross-sectional views showing the movements of a rotor, a hammer and an anvil included in the embodiment of FIG. 1.

Referring to FIG. 1 a casing 1 is provided with a handle 2 into which a compressed air is introduced in a known manner to rotate a pneumatic motor 4 in the clockwise or anti-clockwise direction through the operation of a trigger 3 and a changeover-valve (not shown). The pneumatic motor 4 has a rotating shaft 6 to which a cylindrical rotor 5 is spline-connected so as to effect a unitary rotation. As best shown in FIGS. 2 and 3, the cylindrical rotor 5 has a cylindrical inside wall surface 5*a* on which a lengthwise projection 7 is formed. The projection 7 is defined by recessed sides 7*a* and 7*b*, and continuous to round grooves 8*a* and 8*b* at its foot. The cylindrical inside wall surface 5*a* has a round recess 9, which is formed by cutting away the front portion of the projection 7 such that its round surface is on the same curve with the bottoms of the grooves 8*a* and 8*b* as shown by dotted lines in FIGS. 3 and 4.

An anvil 10 is rotatively provided in the casing 1. In the illustrated embodiment the anvil 10 has a head 10*a*, a body 10*b* and a tail 11, wherein the body 10*b* having a relatively large diameter than that of the head 10*a*, is fully accommodated in the cylindrical rotor 5. The tail 11 is rotatively inserted in a supporting recess produced in a rear section 5*b* of the cylindrical rotor 5. The head 10*a* is adapted to hold a socket (not shown) for supporting a bolt or a nut.

Figure 4:
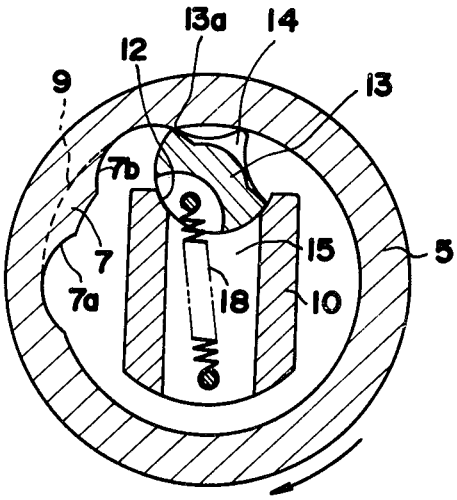

The body 10*b* of the anvil 10 has a slot 12 axially formed to receive a hammer 13, which slot is semi-circular in cross-section as shown in FIGS. 2 to 4. The hammer 13 is rotated in the slot 12 in the clockwise or in the anti-clockwise direction as described below.

The hammer 13 has a semi-circular bottom to meet the semi-circular inside surface of the slot 12. The depth of the hammer 13 which sinks in the slot 12 must be carefully decided; its optimum state is shown in FIG. 2 in which opposite side ridges 13*a* and 13*b* of the hammer are not engaged in the slot 12, positioning on the plane crossing the diameter of the cylindrical rotor 5 at right angle. The hammer 13 has a top ridge 14 axially projecting. The top ridge 14 is adapted to keep contact with the cylindrical inside surface 5*a* except when it passes through the region of the recess 9. When the top ridge 14 is in contact with the cylindrical inside surface 5*a*, the hammer as a whole rotates as shown in FIGS. 3 and 4, and one of the side ridges 13*a* or 13*b* comes into engagement with the cylindrical inside surface 5*a* and slides thereon. As the rotor 5 rotates, the side ridge 5*a* or 5*b* continues to slide on the cylindrical inside surface 5*a* until it comes into engagement with the recessed side 7*b* or 7*a*, depending upon the clockwise or the anti-clockwise rotation. The anvil 10 has an internal space 15 which is formed by boring in the bottom of the slot 12. The internal space 15 accommodates a spring 18, which is connected at one end to a pin 17 provided integral with the hammer 13 and at the other end to a pin 16, thereby exerting a pull on the hammer 13.

A typical example of the operation will be explained:

The pneumatic motor 4 is rotated, for example, in the clockwise direction by operating the trigger 3 and the changeover-valve (not shown). As shown in FIG. 3, the cylindrical rotor 5 is rotated in the clockwise direction with respect to the hammer 13. At this stage, the hammer 13 is caused to swing or tilt against the spring 18 in the clockwise direction, with the side ridge 13*a* sliding on the cylindrical inside surface 5*a*. As the rotor 5 is further rotated, the side ridge 13*a* reaches the round groove 8*b* as shown in FIG. 4, and as it is still further rotated, the side ridge 13*a* comes into engagement with the recessed side 7*b*. In this way the motion of the rotor 5 is transmitted to the anvil 10 through the hammer 13.

Figure 5:
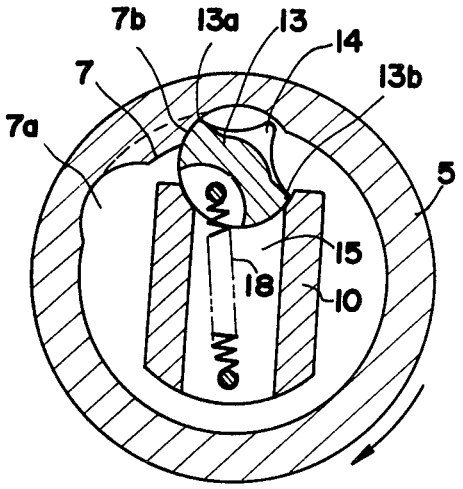

The engagement of the projection 7 with the hammer 13 takes place during one rotation of the rotor 5. Even when the side ridge 13*a* of the hammer 13 is free from the cylindrical inside surface 5*a* of the rotor 5 while passing in the region of the round groove 8*b*, the top ridge 14 keeps contact with the cylindrical inside surface 5*a*, thereby enabling the hammer 13 to maintain its tilted posture. When the top ridge 14 is free from the cylindrical inside surface 5*a*, the other side ridge 13*a* in turn comes into engagement with the cylindrical inside surface 5*a* as shown in FIG. 5, thereby enabling the hammer 13 to keep its tilted posture.

In these situations the spring 18 gives no influence on the rotation of the anvil 10, because its tension is previously designed not to exceed the sum of the centrifugal force exerting on the hammer 13 due to the rotation of the rotor 5 and the frictional force occurring between the recessed side 7*b* and the side ridge 13*a* or 13*b*. As a result, the engagement of the hammer 13 with the projection 7 is effectively maintained, thereby securing a continuous associated rotation of the rotor 5 and the anvil 10. In this way a bolt or a nut in the socket (not shown) attached to the head 10*a* of the anvil 10 is rotated for fastening.

Figure 6:
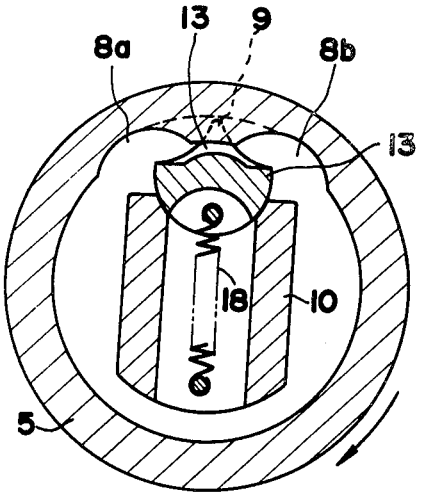
Figure 7:
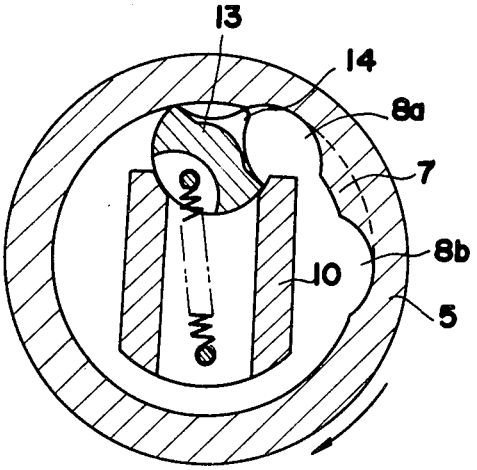

When the bolt or the nut is rotated to the end and cannot rotate any longer, it works as a brake upon the motor torque. At this stage, so long as the hammer is engaged with the projection 7 of the rotor 5, the rotation of the anvil 10 is slowed down, almost coming to a standstill. Thus the centrifugal force gradually lessens so that the spring 18 can restore its normal state. The hammer 13 is rotated in the anticlockwise direction as shown in FIG. 6, and is caused to line up with the axis of the anvil 10, with the hammer 13 being disengaged from the projection 7 of the rotor 5. Thus, the rotor 5 continues to rotate with the top ridge 14 passing in the region of the round recess 9. At the next stage, the top ridge 14 passes the projection 7, and comes into engagement with the round groove 8*a*. The hammer 13 is again caused to tilt as shown in FIG. 7, in which the side ridge 13*a* is placed into engagement with the cylindrical inside surface 5*a*.

At this stage, if any resisting force exceeding the torque of the motor 4 occurs in the anvil 10, the hammer 13 is readily disengaged from the projection 7 of the rotor 5 by overcoming the centrifugal force acting thereon. After one rotation of the rotor 5 the hammer 13 again comes into engagement with the projection 7. As the resisting torque increases, the impact between the hammer 13 and the projection 7 becomes larger. As a result of such repeated impacts the bolt or the nut is fastened.

When a bolt or a nut is to be unfastened, the motor 4 is rotated in the reverse direction (the anti-clockwise direction), and the engagement and disengagement between the side ridge 13*b* and the recessed side 7*a* are carried out in the same manner as when the motor 4 is rotated in the clockwise direction.

Figure 8:
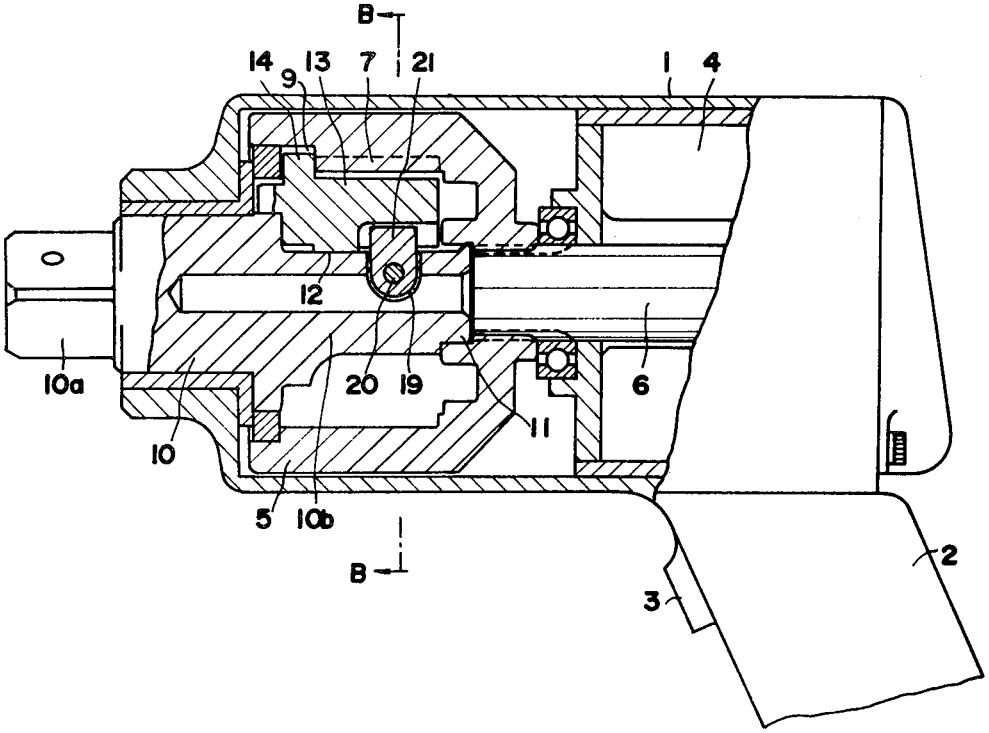
FIG. 8 is a vertical cross-section through a modified version of the embodiment.
Figure 9:
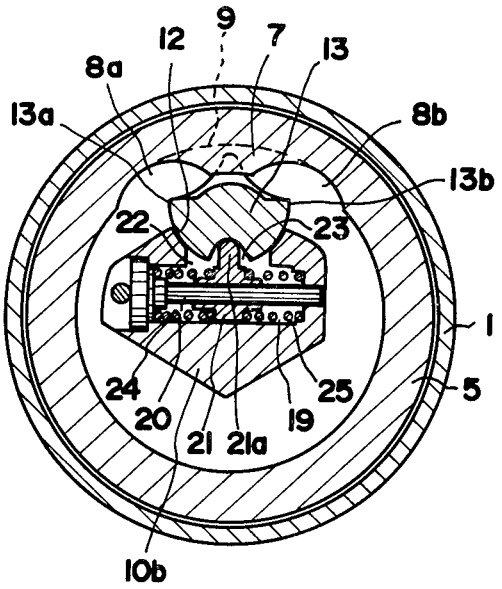
FIG. 9 is a vertical cross-section taken along the line B—B in FIG. 8.

Referring to FIGS. 8 and 9 a modified version of the embodiment will be explained:

In this embodiment a pair of compression springs 24 and 25 are employed to push the hammer 13. The compression springs 24 and 25 are accommodated in a bore 19 produced transversely through the body 10*b* of the anvil 10. The reference numeral 20 designates a bar transversely supported in the bore 19, the bar supporting a slider 21 having a crest 21*a*. The hammer 13 has a bottom recess 23 in which the crest 21*a* is received. In FIG. 9 the reference numeral 22 designates a lengthwise space communicating with the slot 12, the lengthwise space being adapted to allow the crest 21*a* of the slider 21 to play in. The compression springs 24 and 25 are respectively provided between the slider 21 and the end portion of the bar 20.

In this arrangement, when the hammer 13 is tilted in the clockwise direction in FIG. 9, the slider 21 is caused to move to the left, thereby compressing the left-hand compression spring 24. If the hammer 13 is tilted in the anti-clockwise direction, the right-hand compression spring 25 is compressed. In this way the hammer 13 is constantly urged to line up with the axis of the anvil 10.

What is claimed is:

1. An impact wrench comprising a casing, driving means situated in said casing, a cylindrical rotor rotationally disposed in said casing to be driven by said driving means, said rotor including a cylindrical inner surface, a recess extending radially outwardly from the inner surface of the rotor and partially around the circumference of the rotor in a plane orthogonal to the axis of the rotor, and a projection adjacent to said recess and radially inwardly extending beyond said cylindrical inner surface, said projection having round said portions at both sides thereof, an anvil rotationally situated in said cylindrical rotor, said anvil having a slot thereon located inside said cylindrical rotor and a head outside said cylindrical rotor for transmitting power from said driving means outwardly.

a hammer pivotally disposed in the slot of the anvil, said hammer having a pair of side ridges extending substantially the entire length of said hammer and a top ridge between the side ridges so that when said hammer is tilted relative to the anvil, one of the side ridges and the top ridge contact the inner surface of the cylindrical rotor to thereby allow the cylindrical rotor to rotate freely relative to the hammer, and when the tilted hammer engages the round side portion of the projection of the cylindrical rotor, the hammer transmits rotation of the cylindrical rotor to the anvil, and tension means situated between the anvil and the hammer to urge the top ridge of the hammer to orient radially outwardly of the cylindrical rotor so that when said top ridge of the hammer is located in the recess and extends on a radial line of said cylindrical rotor, said side ridges pass freely over the projection of the cylindrical rotor to thereby allow the cylindrical rotor to rotate without rotating the anvil.

2. An impact wrench according to claim 1, in which said recess is located at an outer end of said cylindrical rotor, and the top ridge is provided at an end of the hammer so that the top ridge can pass through the recess.

3. An impact wrench according to claim 1, which said anvil is provided with an internal space, said tension means being situated in said space to connect the anvil and the hammer.

4. An impact wrench according to claim 3, in which said tension means is a coil spring.

5. An impact wrench according to claim 3, in which said hammer includes a bottom recess, and said tension means includes a bar transversely situated in said internal space, a slider with a crest slidably located on the bar, and two springs on said bar to urge the slider in the middle of said bar, said bottom recess of the hammer being located on the crest.

* * * * *